United States Patent [19]

McCammon

[11] Patent Number: 4,546,225

[45] Date of Patent: Oct. 8, 1985

[54] BEARING SUPPORT FOR MICROWAVE OVEN ANTENNA

[75] Inventor: Patrick R. McCammon, Cedar Rapids, Iowa

[73] Assignee: Amana Refrigeration, Inc., Amana, Iowa

[21] Appl. No.: 731,439

[22] Filed: May 7, 1985

[51] Int. Cl.[4] ..... H05B 6/72

[52] U.S. Cl. ..... 219/10.55 F; 219/10.55 R

[58] Field of Search ..... 219/10.55 F, 10.55 R, 219/10.55 E

[56] References Cited

U.S. PATENT DOCUMENTS

| | | | |
|---|---|---|---|
| 4,185,181 | 1/1980 | Kaneko et al. | 219/10.55 F |
| 4,296,297 | 10/1981 | Miller | 219/10.55 F |
| 4,326,112 | 4/1982 | Tanaka et al. | 219/10.55 F |
| 4,436,973 | 3/1984 | Ikeda et al. | 219/10.55 F |
| 4,458,126 | 7/1984 | Dills et al. | 219/10.55 F |
| 4,496,814 | 1/1985 | Fitzmayer | 219/10.55 F |
| 4,508,946 | 4/1985 | Yoshimura et al. | 219/10.55 F |

*Primary Examiner*—Philip H. Leung

*Attorney, Agent, or Firm*—William R. Clark; Joseph D. Pannone

[57] ABSTRACT

A microwave oven having a low friction bearing support for a rotatable microwave feed assembly which includes a primary radiating antenna axially coupled to a cylindrical metal stub that vertically extends from the microwave cavity through an aperture into the waveguide where it is excited by microwave energy. The stub has a bottom cylindrical bore which inserts over a microwave transparent post that extends upwardly through the aperture from a horizontal cross bar suspended by two legs connected to the cavity ceiling. The cross bar may be oblique to the waveguide to centrally and positively align the post in the aperture. The roof of the bore has a downward spherical surface which provides a low friction bearing with the microwave post. The feed assembly also includes a microwave transparent turbine against which a stream of air is directed to rotate the feed assembly.

12 Claims, 10 Drawing Figures

FIG. 7
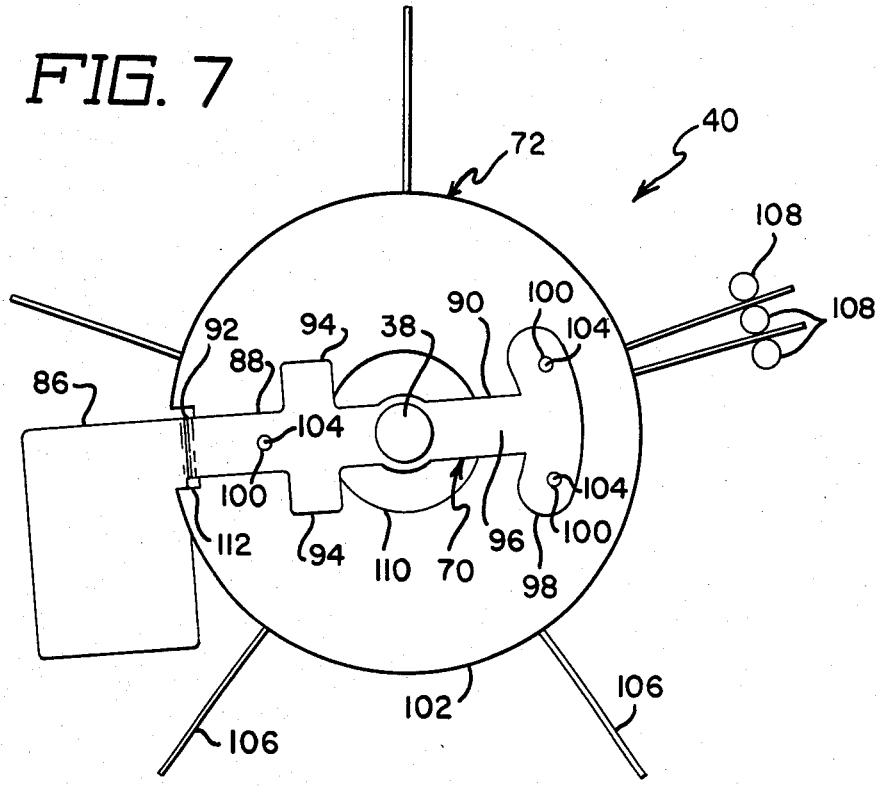
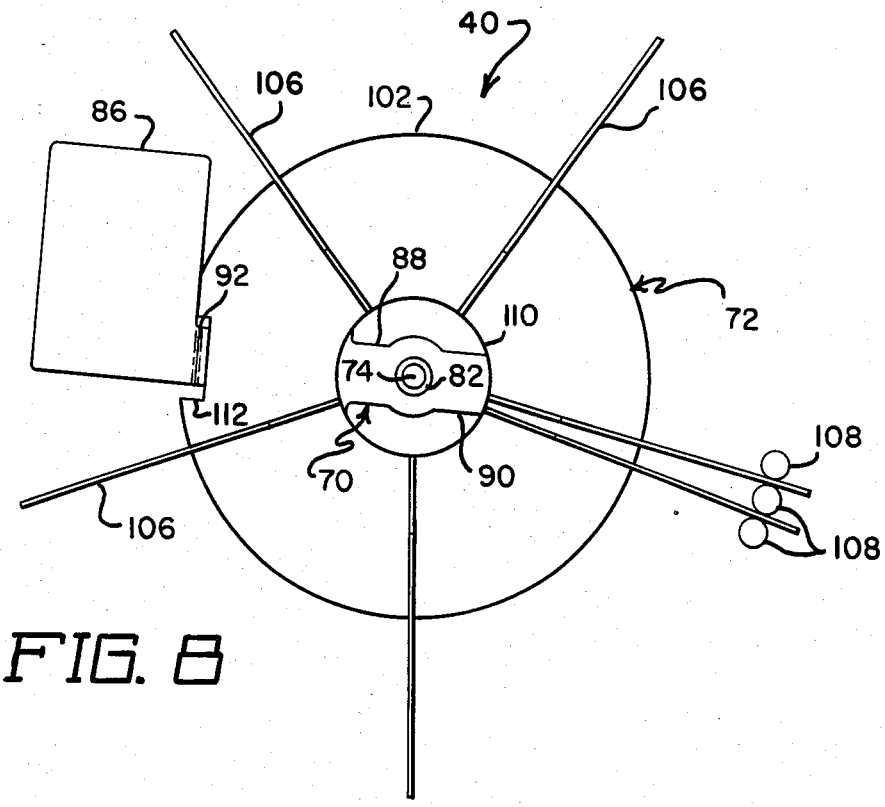
FIG. 8

BEARING SUPPORT FOR MICROWAVE OVEN ANTENNA

BACKGROUND OF THE INVENTION

Since microwave ovens were first introduced, it has been well known that the spatial distribution of microwave energy in the cavity tends to be nonuniform. The nonuniformity has resulted in hot and cold spots within food being cooked and this, of course, is undesirable. Accordingly, there has been extensive and continuous development work to improve the time averaged spatial distribution of energy within the cavities of microwave ovens. The spatial distribution is in part a function of the reflections of microwave energy from the conductive walls thereby producing complex configurations of electromagnetic fields which have commonly been referred to as modes. Simply stated, a major reason for the nonuniformity of the spatial distribution of microwave energy is the constructive and destructive interference of reflections. For example, where reflections add, a hot spot is created and where they subtract, a cold spot is created.

The most common approach for improving nonuniform heating in prior art microwave ovens has been to use a mode stirrer which attempts to randomize reflections and alter the modes by introducing a time-varying scattering of the microwave energy. Typically, a mode stirrer is a metal paddle or propeller which rotates to alter the modes so that the spatial positions of constructive and destructive interference move.

Mode stirrers have been rotated using either a motor drive or directing a flow of air against the propellers. In one air flow approach, a vertical microwave transparent posts extends upward from a mounting bracket and an axial bore in a microwave transparent hub of the metal mode stirrer inserts over it. A small low-friction ball was positioned on top of the post to minimize the rotational friction between the hub of the mode stirrer and the post.

Another prior art approach to providing uniform spatial distribution of microwave energy was to utilize a primary radiator. More specifically, the microwave energy is coupled directly from the waveguide to a microwave antenna which preferably has a directive pattern. Further, uniformity has been provided by rotating the antennas. One prior art approach for supporting a rotatable microwave antenna and coupling microwave energy to it is described in U.S. Pat. No. 4,335,289. An antenna probe, which extends through an aperture between the waveguide and the cavity, is excited and functions as a coaxial center conductor. The microwave antenna was connected to the probe in the cavity. To rotatably position the antenna probe in central alignment within the aperture, a plastic bushing with a central bore was mounted in the aperture and the antenna probe was inserted therethrough. A flow of air was blown against vanes connected to the antenna to provide rotation. Although the bushing adequately functioned to align vertically the antenna probe in the center of the aperture, the friction between the probe and the bushing caused the antenna to rotate at a relatively slow speed. This was a problem becuase the scan rate of a factory leakage test is specified by an approval agency to be a function of the antenna rotation speed. Accordingly, if the antenna is rotating slowly, each oven has to be tested for a longer period of time. The problem would become exaggerated if the air flow was reduced for any reason.

SUMMARY OF THE INVENTION

It is an object of the invention to provide a microwave oven with an air driven microwave antenna that rotates relatively fast.

It is another object of the invention that a rotatable microwave feed be supported by a vertical post. Further, it is an object that the microwave feed include a vertical probe centrally and positively aligned in an aperture communicating from the waveguide to the microwave cavity. Also, it is an object that the friction between the post and the vertical probe be low so that the rotation rate of the microwave feed will be high.

These and other objects are provided in accordance with the invention which defines a microwave oven comprising a microwave cavity comprising side walls, a back wall, a floor, and a ceiling, a waveguide positioned above the ceiling, an aperture communicating from the waveguide through the ceiling to the cavity, a bracket having an arm spaced from the ceiling underneath the aperture, the bracket having a vertical bearing post extending through the aperture into the waveguide, a metal stub having a hollow bore inserted down over the bearing post for rotatably supporting the stub on the post, the stub extending from the waveguide through the aperture into the cavity, a primary radiator coupled to the bottom end of the stub in the cavity, means for energizing the waveguide with microwave energy wherein the stub couples the microwave energy from the waveguide into the cavity for radiation from the primary radiator, and means for rotating the stub on the post. It may be preferable that the bracket be transparent to microwave energy. Also, the arm may be oblique to the waveguide. Further, it may be preferable that the bore of the stub have a roof with a downward extending protrusion for minimizing the area of contact with the post so that the primary radiator will rotate at a faster rate. The downward extending protrusion may be spherically shaped. Also, it may be preferable that the bore be tapered.

The invention may also be practiced by a microwave oven comprising a microwave cavity having side walls, a back wall, a floor and a ceiling, a waveguide positioned above the ceiling, an aperture in the ceiling communicating with the waveguide, a microwave transparent cradle comprising two legs and a horizontal cross member, the upper ends of the legs being connected to the ceiling, the cross member extending underneath the aperture spaced from the ceiling, a microwave transparent bearing post extending vertically upward from the cross member, a cylindrical rod having a bore extending axially from one end, the bore being inserted over the post for rotatably supporting the rod in vertical disposition from the waveguide through the aperture into the cavity, a conductor extending horizontally from the bottom end of the rod, a primary radiator such as an antenna connected to the conductor, means for energizing the waveguide with microwave energy wherein the energy couples from the rod to the conductor to the primary radiator for radaition into the cavity, and means for rotating the rod on the post wherein the primary radiator moves in a circular horizontal path in the cavity. The bore may have a downward extending ball-shaped roof for minimizing the area of contact and rotating friction between the rod and the bearing post. The rotating means may comprise microwave transparent vanes connected to the conductor. The rotating means may further comprise means for directing a flow of air against the vanes.

BRIEF DESCRIPTION OF THE DRAWINGS

The foregoing objects and advantages will be more fully understood by reading the Description of the Preferred Embodiment with reference to the drawings wherein:

FIG. 7 is a top view of the microwave feed assembly;

FIG. 8 is a bottom view of the microwave feed assembly;

DESCRIPTION OF THE PREFERRED EMBODIMENT

Figure 1:
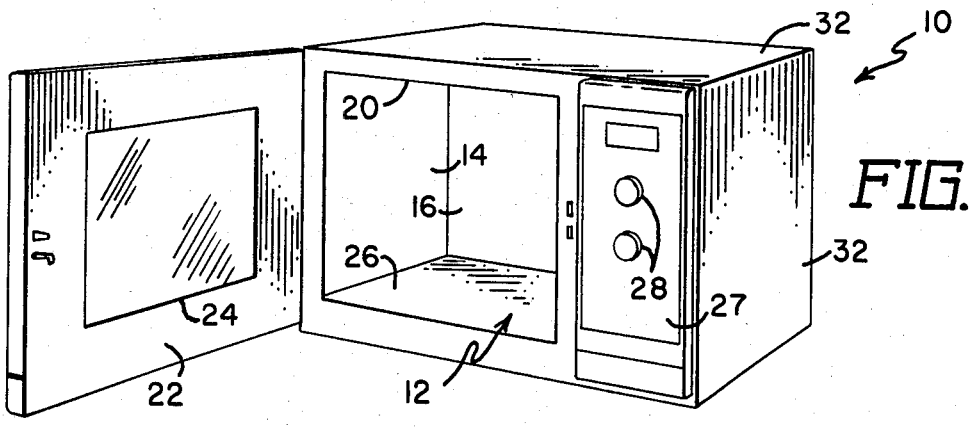
FIG. 1 is a front perspective view of a microwave oven.

Referring to FIG. 1, a front perspective view of a microwave oven 10 is shown. The cavity 12 of microwave oven 10 is generally defined by side walls 14, back wall 16, floor 18 (FIG. 3), ceiling 20 and door 22 which preferably includeds a window 24 for observing the cooking. Door 22 also includes a suitable choke for preventing the escape of microwave energy from microwave cavity 12. A microwave transparent support tray 26 is elevated above floor 18. A control panel 27 including control knobs 28 is provided for activating and controlling the source of microwave energy such as magnetron 30 (FIG. 2) in conventional manner. Top and side casing 32 surrounds the outside of microwave oven 10.

Figure 2:
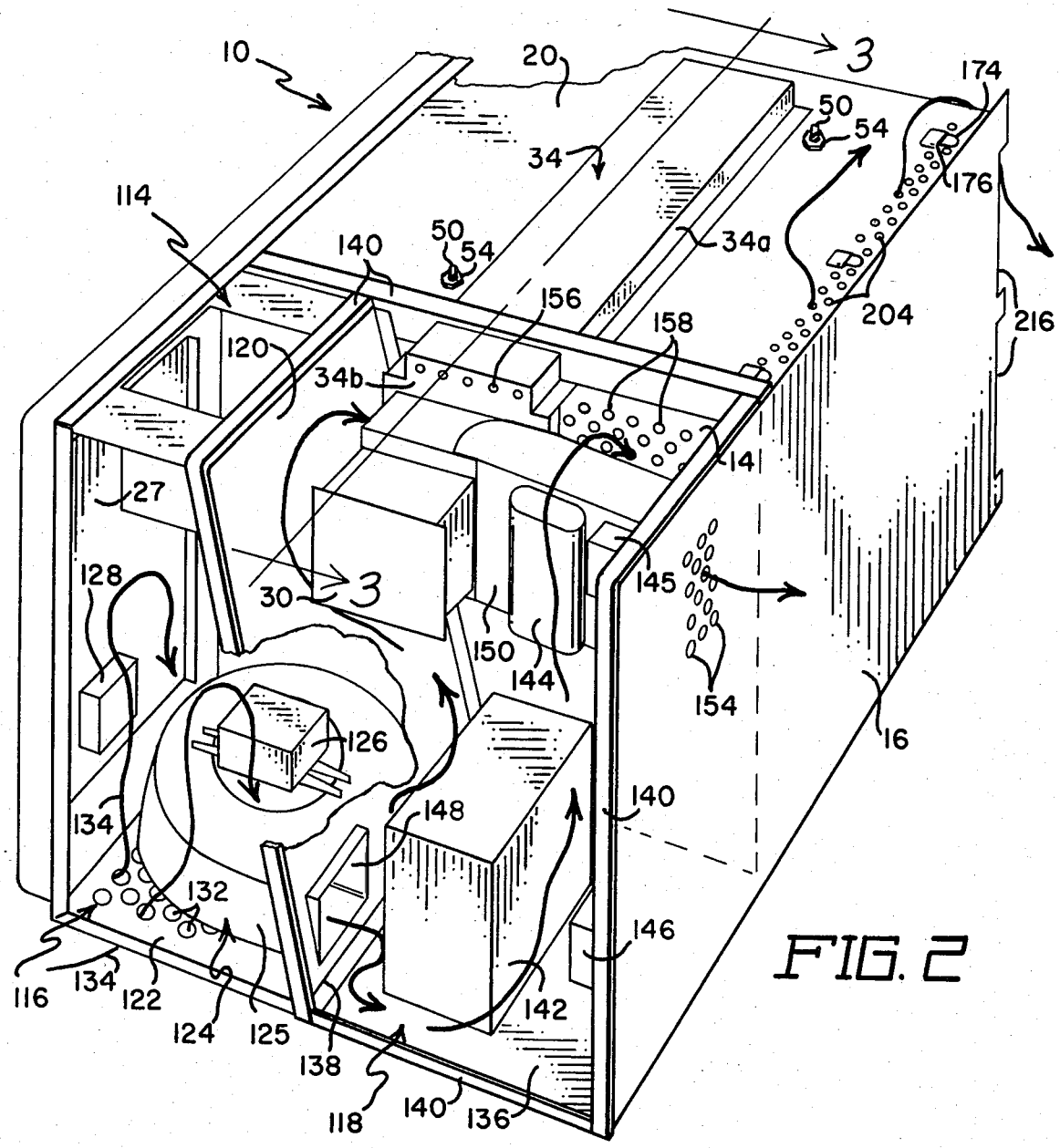
FIG. 2 is a side rear partially broken away perspective view of the microwave oven with the top and side casing removed.
Figure 3:
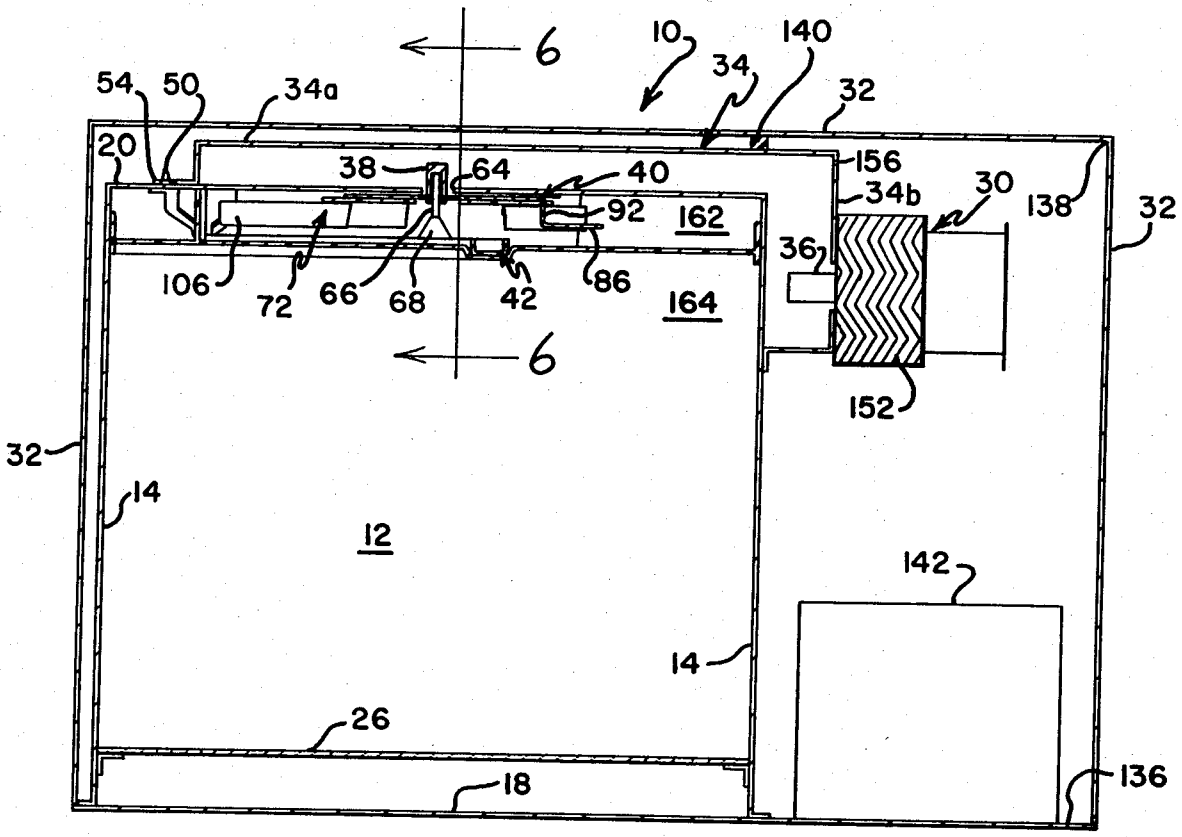
FIG. 3 is a front sectional view of the oven.

Referring to FIG. 2, there is shown a partially brokenaway right rear perspective view of microwave oven 10 with top and side casing 32 removed. FIG. 3 shows a front sectional view of microwave oven 10. Waveguide 34, which is parallel to back wall 16, consists of a horizontal section **34*a* running across the top of ceiling 20 and a vertical section 34*b* along the right side wall 14. The output probe 36 of magnetron 30 inserts into vertical section 34*b* to which the magnetron 30 is mounted. When magnetron 30 is activated in response to control knobs 28, microwave energy at a frequency such as, for example, 2450 MHz travel up waveguide vertical section 34*b*, across waveguide horizontal section 34*a* and excites antenna probe 38 for coupling into cavity 12. Waveguide section 34*a* extends considerably past antenna probe 38 to increase the rigidity of ceiling 20. The precise length of waveguide section 34*a* is selected to optimize the impedance match and power transfer to antenna probe 38**.

Figure 4:
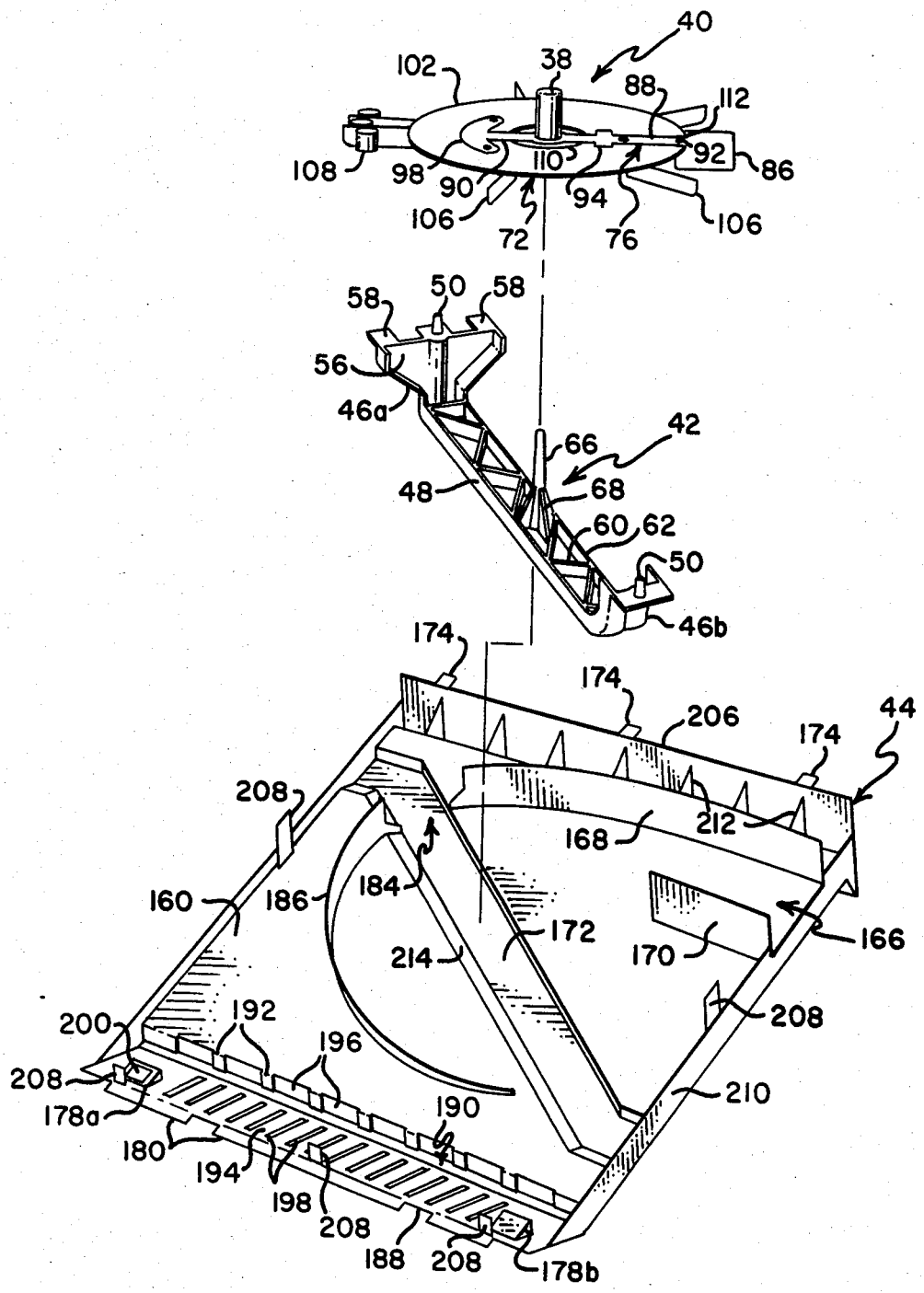
FIG. 4 is an exploded view of the microwave feed assembly, cradle, and grease shield.
Figure 5:
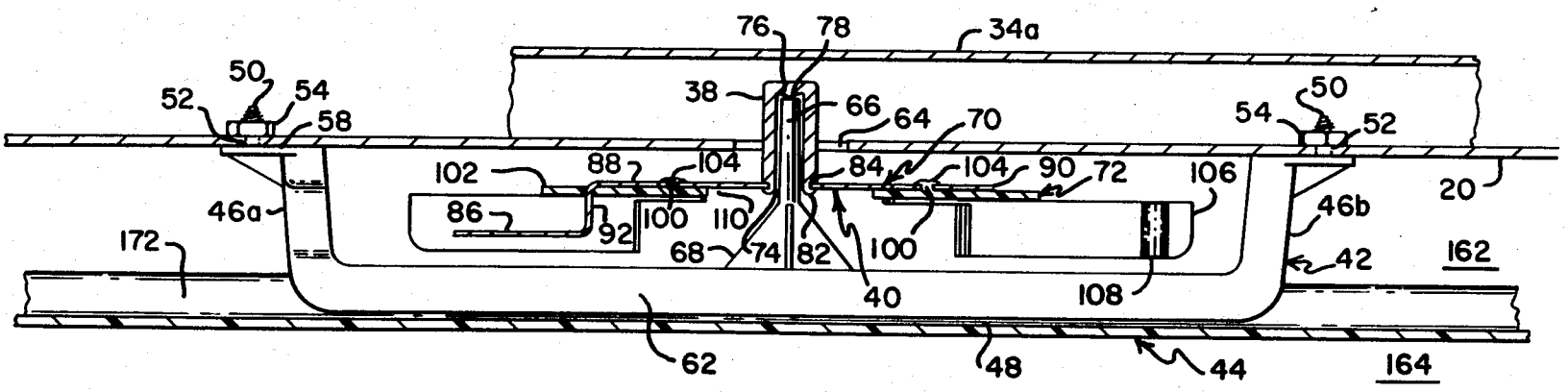
FIG. 5 is a sectioned elevation view taken along the cradle.
Figure 6:
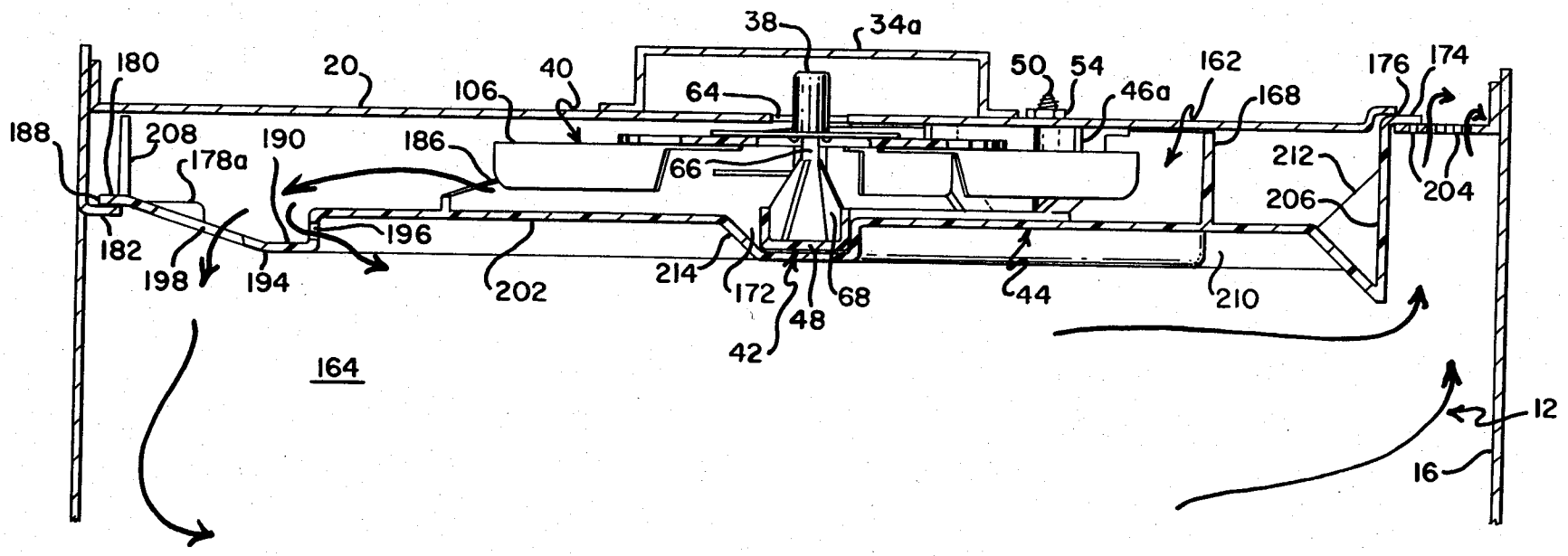
FIG. 6 is a side elevation view taken along line 6—6 of FIG. 3.

Referring to FIG. 4, an exploded view of microwave feed assembly 40, mounting cradle 42 and grease shield 44 are shown. Referring to FIGS. 5 and 6, sectional elevation views taken along cradle 44 and along line 6—6 of FIG. 3 are shown. Cradle 42, which is molded from a microwave transparent material such as plastic, has two legs **46*a* and 46*b* with a horizontal cross bar or arm 48. Each leg 46*a* and 46*b* has a pin 50 or fastening post which inserts up through a small hole 52 in ceiling 20 for engagement by a suitable fastener such as a nut 54 or clip. Leg 46*a* has wings 56 which extend to platforms 58 which seat against ceiling 20 to secure the attitude of cradle 42. Horizontal arm 48 is here shown with diagonal struts 60 and side slats 62 to make it rigid. Arm 48 of cradle 42 is mounted oblique to waveguide 34 and extends underneath circular aperture 64 which communicates from waveguide horizontal section 34*a* to cavity 12. A vertical support post 66 with braces 68 extends upwardly from horizontal arm 48 and inserts through aperture 64. The oblique mounting of cradle 42 helps to prevent bending or "oil canning" of ceiling 20 altering the alignment of supporting post 66 and aperture 64. More specifically, the angle between cradle 42 and the axis of waveguide 34 is relatively small to more securely locate supporting post 66 in the center of aperture 64; in one embodiment where cradle 42 was mounted perpendicular to waveguide 34, ceiling 20 buckled slightly and the downward bow altered the alignment between supporting post 66 and aperture 64. For illustration, cradle 42 may have a length of approximately 10 inches and legs 46*a* and 46*b* may space horizontal arm 48 about $1\frac{1}{8}$ inches from ceiling 20. Also, supporting post 66 may extend up into waveguide 34** approximately $\frac{1}{2}$ inch and have an upper flat diameter of 0.175 inches tapering outwardly to a diameter of 0.196 inches approximately $\frac{3}{4}$ inches below.

Now, with additional reference to FIGS. 7 and 8, there are shown top and bottom views, respectively, of microwave feed assembly 40 with includes antenna probe 38, conductive strip 70 and microwave transparent turbine 72. As shown best in FIG. 5, antenna probe 38 is a cylindrical stub having a bottom axial bore 74 which is placed over support post 66. The roof 76 of bore 74 which supports microwave feed assembly 40 on support post 66 has a downwardly extending ball 78 or spherically shaped protrusion for minimizing the contact area and rotational friction between the bearing surfaces. As an example, bore 74 may have a length of approximately 0.8 inches with a top diameter of 0.19 inches tapering outwardly to approximately 0.21 inches. The outer diameter of antenna probe 38 may be $\frac{1}{2}$ inch. The bottom of antenna probe 38 has a flange 82 which inserts through hole 84 in conductive strip 70 and then is secured thereto by an orbital peen.

Still referring to FIGS. 5, 7, and 8, conductive strip 70 includes a flag or patch antenna 86, a strip conductor 88 and a strip support 90 or strip connector. Conductive strip 70 is punched or cut from a flat sheet of aluminum alloy having a thickness of approximately 0.032 inches. Flag antenna 86 defines a rectangle having rounded corners. In the direction of strip conductor 88, flag antenna 86 has a dimension of 1.281 inches with a transverse dimension of 1.968 inches. From hole 84, strip conductor 88 has a horizontal length of approximately 2 inches to a downwardly bent section 92 which spaces flag antenna 86 approximately 0.5 inches below the plane of the rest of strip conductor 88. Strip conductor 88 is spaced approximately 0.3 inches from ceiling 20 so flag antenna 86 is spaced approximately 0.8 inches. Strip conductor 88 has two outwardly extending tabs 94 on opposing sides approximately 0.625 inches from hole 84. Tabs 94, which extend outwardly approximately 0.375 inches for a distance of 0.5 inches enhance the impedance match between antenna probe 38 and flag antenna 86. Strip support 90 has a segment 96 approximately 1.3 inches long to a curved anchor segment 98. Conductive strip 70 has three holes 100 to connect it to turbine 72. More specifically, turbine 72 has a horizontal disk 102 with three bosses 104 which are aligned with holes 100. In connecting plastic turbine 72 to conductive strip 70, the bosses 104 are respectively inserted up through holes 100 and then melted or ultrasonically welded for permanent attachment. On the bottom side of disk 102, turbine 72 has a plurality of vertical radial vanes 106 or paddles which cause microwave feed assembly 40 to rotate when impinged by a stream of air as will be described in detail later herein. Vanes 106 may have weights 108 to balance microwave feed assembly 40 about its vertical axis of rotation through hole 84 and antenna probe 38. The radius of each vane 106 from the axis of rotation is approximately 3.75 inches. Disk 102 has a central aperture 110 through which orbital peened flange 82 extends. Also, disk 102 has a notch 112 where vertical section 92 of strip conductor 88 extends downwardly.

In operation, the microwave energy in waveguide 34 excites microwave currents on antenna probe 38 thereby coaxially coupling the energy down antenna probe 38 through circular aperture 64 to the junction with conductive strip 70. Most of the microwave current conducts in the direction of strip conductor 88 rather than strip support 90 because the described geometry of strip support 90 has a high input impedance. More specifically, the oppositely directed arms of anchor segment 98 are joined in parallel to provide a low impedance which transforms to a high impedance at the input to strip support 90 which is approximately a quarter wavelength away. The two arms of anchor segment 98 should not total a half wavelength because that could cause high filed strength and possible arcing if cavity 12 were operated without a load. There is very little radiation of microwave energy along strip conductor 88 because, as shown best in FIG. 5, it is closely spaced to ceiling 20 which functions as a ground plane or plate. More specifically, strip conductor 88 is parallel and spaced approximately 0.3 inches or less than one-eighth wavelength from from ceiling 20 so that it is equivalent to an air dielectric microstrip line. According to well-known principles, the closely spaced ground plate or reflector maximizes transmission and minimizes radiation. Strip support 90 is also closely spaced to ceiling 20 so that the relatively small currents traveling in that direction would have a high radiation resistance.

The microwave currents travel down the 0.5 inch vertical length of strip section 92 to flag antenna 86. Because the flag antenna 86 is spaced approximately 0.8 inches or substantially more than one-eighth wavelength below ceiling 20 which functions as a ground plane, flag antenna 86 is an effective radiator of microwave energy. Radiation from flag antenna 86 is also enhanced because it is resonant thereby increasing the current flow. The long dimension of the rectangle of flag antenna 86 which is 1.968 inches long is resonant at a frequency F1 below the operating frequency; accordingly, the current in that direction lags the excitation voltage. The short dimension of the rectangle of flag antenna 86 which is 1.281 inches long is resonant at a frequency F2 above the operating frequency; accordingly, the current in that direction leads the excitation voltage. With these rectangle dimensions in the described cavity environment, flag antenna 86 provides a pattern with substantially circular polarization over a relatively large angle. More specifically, the orthogonal components radiated from flag antenna 86 are substantially equal in magnitude and their phases have a difference of approximately 90°. The dimensions of flag antenna 86 were empirically determined by using rectangles of different dimensions as radiating antennas and measuring the relative signal strengths and phases received with a linearly polarized antenna alternately held parallel to the two orthogonal directions of the rectangles. The results of the tests were plotted as functions of the lengths of the sides. Intensity contours of equal magnitude and 90° phase differences were estimated from the data to obtain the optimum dimensions.

Ideally, the maximum orthogonal current amplitudes and the radiated components at resonant frequencies F1 and F2 are equal such that F1 and F2 could be displaced such that their respective half power points occur at the operating frequency so that the current of one leads the excitation by 45° and the current of the other lags the excitation voltage by 45°. In this way, the currents in the orthogonal directions would have a phase differential of 90°. However, even if the maximum radiated components at resonant frequencies F1 and F2 are unequal, the dimensions of the rectangle of flag antenna 86 can be selected such that resonant frequencies F1 and F2 are moved up or down from the ideal F1 and F2 frequencies to compensate. More specifically, for a strong F1 excitation, resonant frequencies F1 and F2 are moved down in frequency to provide equal radiated components with a phase difference of 90° at the operating frequency; for a strong F2 excitation, resonant frequencies F1 and F2 are moved up in frequency to provide equal radiated components with a phase difference of 90° at the operating frequency.

Many other embodiments of flag antennas and feed structures could be used to radiate substantially circular polarization into cavity 12. For example, flag antenna 86 could be oblique to strip section 92 rather than at a right angle. Also, strip section 92 could be perpendicular to the short side rather than to the long side or it might be connected anywhere along either side. Further, the width of strip section 92, here 0.5 inches, could be different and it could have a different length. Also, a plurality of flag antennas 86 could be used. It should be recognized, however, that the optimum dimensions of flag antenna 86 are a function of the operating environment. Accordingly, each one of the described modifications would alter resonant frequencies F1 and F2 and the currents in the two orthogonal directions parallel to the sides of the rectangle. As a result, the dimensions of the flag antenna 86 should be optimized for circular polarization with each configuration.

Because flag antenna 86 is supported by strip conductor 88 rather than a solid dielectric as is commonly used in microstrip patch antennas for radars, flag antenna 86 can be moved freely with respect to ceiling 20 which functions as its ground plane. More specifically, as will be described in detail later herein, flag antenna 86 is rotated about the axis of antenna probe 38 thereby moving the radiated pattern in an offset circular path. Also, the air dielectric between the flag antenna 86 and ceiling 20 stores less energy than a solid dielectric. Accordingly, the operating bandwidth for both radiation and circular polarization is enhanced. While the microwave oven operates in only a narrow band of allowed frequencies, the resonant frequency of the flag antenna 86 is determined, among other things, by its physical size and spacing from ceiling 20. Accordingly, the wider bandwidth increases the tolerance on dimensional variations and positioning of flag antenna 86.

Flag antenna 86 has a lower profile than a helical antenna having a cylindrical segment for providing circular polarization by gradually increasing the spacing from the ground plane. The low profile increases the usable volume of cavity 12 and also permits flag antenna 86 to be rotated above cross arm 48 of a support cradle 42 which has relatively short legs 46*a* and 46*b*.

Again referring to FIG. 2, divider panel 120 separates the chamber 114 behind control panel 27 into a front control compartment 116 and a back power supply compartment 118 or plenum. More specifically, control compartment 116 is bounded by control panel 27, partition or divider panel 120, top and side casing 32, cavity side wall 14, and bottom 122. Blower 124 which includes scroll 125 and motor 126 is positioned in control compartment 116 and, as will be described in detail, provides a forced flow of air for cooling components, for rotating microwave feed assembly 40, and for removing moisture from cavity 12. Control compartment 116 also encases conventional controls 128 such as relays, timers, circuit boards, and interlocks for microwave oven 10. The intake air for blower 124 may be drawn or sucked into control compartment 116 through a variety of passageways such as, for example, openings 132 in bottom 122. Only a relatively small amount of heat is generated in the control compartment 116 and that heat is effectively removed by intake air 134 being drawn across blower motor 126 and controls 128 on its way to scroll 125.

Power supply compartment 118 is an enclosure generally defined by divider panel 120, top and side casing 32, cavity side wall 14, back wall 16 and bottom 136. The seams 138 of power supply compartment 118 are substantially sealed by gasket 140 so that a static pressure differential can be built up between the power supply compartment 118 or plenum and the outside. In addition to power supply components, power supply compartment 118 houses magnetron 30 and may also enclose other components such as a fuse board and an oven light (not shown). More specifically, power supply compartment 118 is here shown housing power transformer 142 and condenser 144 which, along with a rectifier 145, are part of a conventional voltage doubler circuit for providing high voltage such as 4,000 volts to magnetron 30. Also, conventional filament transformer 146 is shown mounted to back wall 16 in power supply compartment 118. The forced air from blower 124 is coupled directly to a chute or aperture 148 through divider panel 120. Power transformer 142 is mounted adjacent to aperture 148 and transverse to the direction of flow of forced convection air from aperture 148. Accordingly, turbulent and relatively high velocity cooling air from blower 124 impinges power transformer 142 first upon entering power supply compartment 118. As a result, the rate of heat flow by convection from power transformer 142 is greater than in prior art microwave ovens. For example, in one prior art embodiment where relatively low velocity substantially laminar air was drawn across a particular power transformer on its way to the blower, the power transformer had a temperature rise in the range from 120° C. to 131° C. That same power transformer 142, however, was found to have a temperature rise of only about 64° C. when mounted in power supply compartment 118 as described herein. As a result of more effective cooling, the size of the power transformer 142 can be reduced without exceeding the maximum allowable temperature standards of approval agencies. The reduced size not only lowers the cost of materials, but it results in less weight which equates to significant advantages in shipping and portability. Another advantage of the above-described embodiment is that the blower motor 126 is positioned in control compartment 116 isolated from the higher heat producing components in the power supply compartment 118. Filament transformer 146 along with condenser 144 and rectifier 145, which are mounted on discharge air duct 150, are cooled by the forced convection air after it flows across power transformer 142.

The convection air forced through aperture 148 by blower 124 creates a static pressure differential between the interior of power supply compartment 118 or plenum and the outside. Accordingly, air flows outwardly from power supply compartment 118 by any available path. Because the seams 138 of power supply compartment 118 are substantially sealed against the passage of air, the air primarily exhausts from power supply compartment 118 through three predetermined and well defined paths or passageways. The first path is through cooling fins 152 of magnetron 30 which communicate through discharge air duct 150 to exhaust ports 154 on back wall 16. The air flow through this first path has to be large enough to provide adequate cooling of magnetron 30. The second path enters perforations 156 in waveguide vertical section 34*b* and flows down the waveguide where it enters cavity 12 through aperture 64; the relatively small air flow in this second path provides some cooling of the magnetron output probe 36. The third path enters cavity 12 through a set of perforations 158 in side wall 14 near ceiling 20. As will be described in detail, the functions of the air flow along the third path are to rotate microwave feed assembly 40 and to remove moisture from cavity 12. Because all of the air entering power supply compartment 118 is directed through aperture 148, the rate of air flow at the power transformer 142 is equal to or greater than the rate of air flow at magnetron 30. For example, the cubic feet per minute of air flowing through aperture 148 is approximately equal to sum of the cubic feet per minute air flow rates through the three described exit paths. Because the air flowing through magnetron 30 is only one of those exit paths, its rate would never be larger than the input rate through aperture 148.

Figure 9:
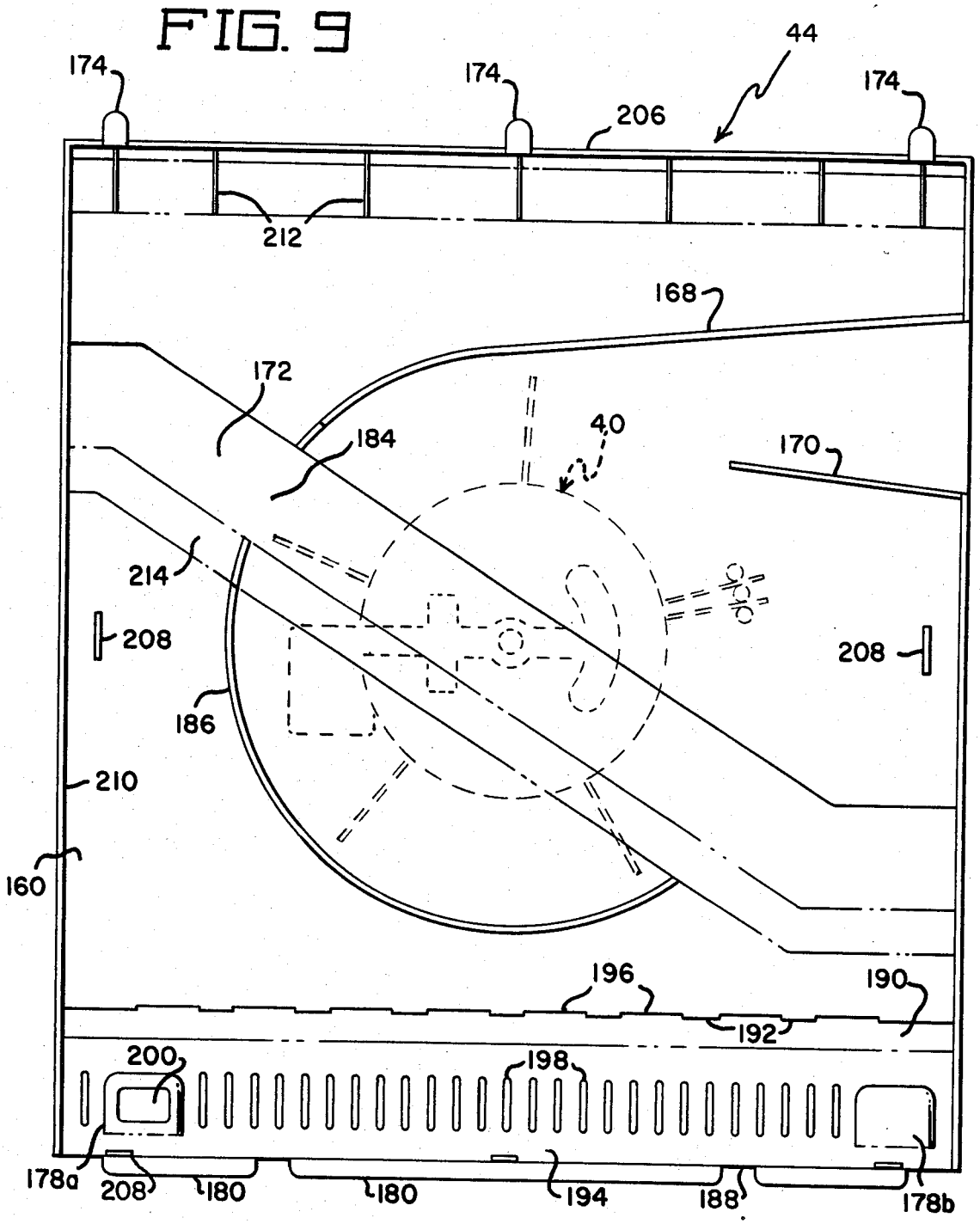
FIG. 9 is a top view of the grease shield depicting the alignment of the microwave feed assembly.
Figure 10:
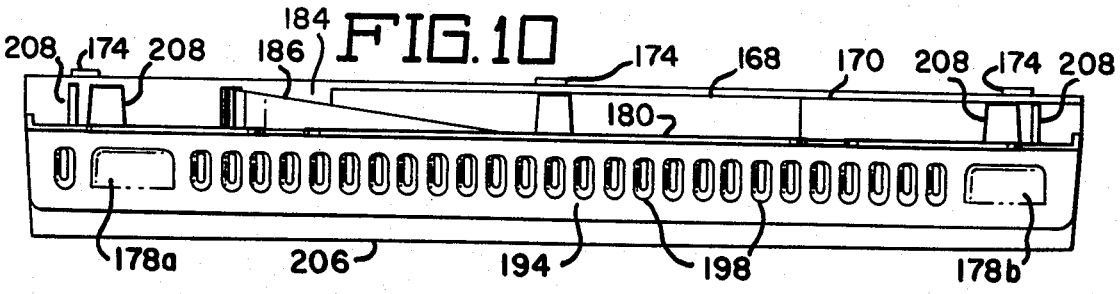
FIG. 10 is a front view of the grease shield.

As described earlier herein, FIG. 4 shows an exploded view including grease shield 44 which may be a plastic molded part. FIG. 6 shows a side sectioned elevation view of cavity 12 and grease shield 44. FIGS. 9 and 10 respectively show top and front views of grease shield 44. FIG. 9 also depicts the alignment of microwave feed assembly 40. Grease shield 44 directs the flow and distribution of air in cavity 12 so as to rotate microwave feed assembly 40 and exhaust moisture from cavity 12. Because a significant portion of the forced air from blower 124 is exhuasted through magnetron 30 to exhaust port 154, there is only a limited amount of air forced through perforations 158 into cavity 12. Accordingly, grease shield 44 must make efficient and effective use of the air in performing its intended functions. Grease shield 44 has a substantially horizontal panel 160 which divides cavity 12 into an upper region or chamber 162 housing microwave feed structure 40 and a lower cooking region or chamber 164. The air from perforations 158 flows by static pressure differential into nozzle or chute 166 formed by horizontal panel 160, ceiling 20 and interconnecting vertical partitions 168 and 170 or dividers. The spacing between partitions 168 and 170 may be closer at the inside such as 2.125 inches as compared to 2.5 inches so that the air is concentrated into a relatively high velocity stream of air directed tangentially at the vanes 106 of turbine 72. Panel 160 has an oblique channel 172 aligned for receiving the arm 48 of cradle 42. If cradle 42 were not recessed in channel 172, the stream of air driving turbine 72 would become turbulent upon impinging side slat 62. Laminar flow, on the other hand, helps to increase the speed of rotation of microwave feed assembly 40. In fact, because of substantially laminar flow and the low rotational friction provided by ball 78, microwave feed assembly may rotate at approximately 120 rpm. This fast rotation is especially advantageous because the scan rate of leaking testing equipment used during manufacturing is determined by the rate of antenna rotation. For example, at 120 rpm, the scan rate along the door can be 2 inches per second. At 60 rpm, however, the scan must be 1 inch per second.

Channel 172 is enough wider than arm 48 of cradle 42 so that grease shield 44 can easily be installed or removed without contacting or disturbing cradle 42. More specifically, as described best with reference to FIG. 6, grease shield 44 is initially installed and then later removed and replaced for cleaning by inserting tabs 174 into suitable receptacles 176, here slots in ceiling 20, and then pushing backward in thumb holds **178*a* and 178*b* to slightly bend grease shield 44 so that front tabs 180 can be inserted or snapped over flange 182 of cavity 12. If the tolerance of channel 172 and cradle 42 were too small, installation and removal of grease shield 44** would be encumbered.

Partition 168 extends approximately out to channel 172 while partition 170 stops short of the rotational circumference defined by vanes 106. Wings 56 of leg **46*a* approximately conform with the gap 184 between partition 168 and partition 186. Accordingly, most of the air stream driving turbine 72 continues inside partition 186 rather than being directed through gap 184**.

Partition 186 and a portion of partition 168 adjacent channel 172 are arcs concentric to the rotational circumference defined by vanes 106. Each arc has a radius of 4.125 inches. From a point approximately 15° to the front of a lateral axis through the center of rotation, the height of partition 186 has a downward linear slope from approximately 1.123 inches where it contacts ceiling 20 to approximately 0.087 inches at its juncture with channel 172 on the right. Accordingly, the air driving stream flows out over partition 186 and it is dispersed with relative uniformity toward the front 188 of grease shield 44. More specifically, where the air stream is strongest, the space between ceiling 20 and partition 186 is smallest to limit the air flowing toward the left front. As the air stream gets weaker in the counter clockwise direction due to dissipation, the space between ceiling 20 and partition 186 gets larger to equalize the air flowing toward the right front.

The uniformly dispersed flow of air from partition 186 travels forward to trough 190 defined by vertical side 192 and sloped front side 194. Vertical side 192 has a plurality of lateral slots 196 and sloped side 194 has a plurality of front-to-back slots 198. The air entering trough 190 by static pressure differential flows from upper chamber 162 to lower cooking chamber 164 through slots 196 and 198. The path initiated from slots 198 flows down along the door and is important to prevent condensation of moisture on window 24 that would reduce visibility of cavity 12. Although partition 186 is sloped downwardly to provide substantially uniform distribution of air flow down along door 22, it was found that the air flow adjacent to the left side was slightly less than the rest resulting in some condensation there. Accordingly, an aperture 200 was located in the left thumb hold **178*a* and the distribution of air flow down door 22 was made more uniform. As shown best in FIG. 6, the path of air flow inititated from slots 196 is directed back along the underside 202 of grease sheild 44 to efficiently and directly exhaust moisture rising from the food. More specifically, if the rising moisture is exhausted directly rather than being dispersed throughout the cavity, the limited air flow is utilized more effectively and efficiently. The air carrying moisture from cavity 12 passes back along the underside 202 and then exhausts through a set of perforations 204 in the ceiling 20 behind the back partition 206 of grease shield 44. The bottom of back partition 206 extends downwardly below the horizontal plane of panel 160 so as to shield perforations 204 from direct splatter of grease. In addition to at least portions of partitions 168, 170, 186 and 206, spacers 208 contact ceiling 20 so as to limit the warping of grease shield 44. Side slats 210 and ribs 212 function as braces to increase the rigidity of grease shield 44. The front side 214 of channel 172** is sloped so as to reduce the turbulence of air flowing across it; the laminar flow provides a more effective use of the limited air flow.

As shown best in FIG. 2, the air exhausting cavity 12 up through perforations 204 flows laterally between the top of ceiling 20 and the top casing 32 to the left side. Then, the air flows downwardly to oven exhaust vents 216. In conformance with safety requirements, the indirect flow of air from cavity 12 prevents flames from coming out of microwave oven 10 in the unlikely event that a fire was burning in the cavity 12.

This concludes the description of the preferred embodiment. A reading of it by those skilled in the art will bring to mind many modifications and alterations without departing from the spirit and scope of the invention. Accordingly, it is intended that the invention only be limited by the following claims.

What is claimed is:

1. A microwave oven, comprising:

a microwave cavity comprising side walls, a back wall, a floor and a ceiling;

a waveguide positioned above said ceiling;

an aperture communicating from said waveguide through said ceiling to said cavity;

a bracket having an arm spaced from said ceiling underneath said aperture, said bracket having a vertical bearing post extending through said aperture into said waveguide;

a metal stub having a hollow bore inserted down over said bearing post for rotatably supporting said stub on said post, said stub extending from said waveguide through said aperture into said cavity;

a primary radiator coupled to the bottom end of said stub in said cavity;

means for energizing said waveguide with microwave energy wherein said stub couples said microwave energy from said waveguide into said cavity for radiation from said primary radiator; and means for rotating said stub on said post.

2. The oven recited in claim 1 wherein said bracket is microwave transparent.

3. The oven recited in claim 1 wherein said arm is oblique to said waveguide.

4. The oven recited in claim 1 wherein said bore has a roof with a downward extending protrusion for minimizing the area of contact with said post.

5. The oven recited in claim 4 wherein said downward extending protrusion is spherically shaped.

6. The oven recited in claim 1 wherein said bore is tapered.

7. A microwave oven, comprising:

a microwave cavity having side walls, a back wall, a floor and a ceiling;

a waveguide positioned above said ceiling;

an aperture in said ceiling communicating with said waveguide;

a microwave transparent cradle comprising two legs and a horizontal cross member, the upper ends of said legs being connected to said ceiling, said cross member extending underneath said aperture spaced from said ceiling;

a microwave transparent bearing post extending vertically upward from said cross member;

a cylindrical rod having a bore extending axially from one end, said bore being inserted over said post for rotatably supporting said rod in vertical disposition from said waveguide through said aperture into said cavity;

a conductor extending horizontally from the bottom end of said rod;

a primary radiator connected to said conductor;

means for energizing said waveguide with microwave energy wherein said energy couples from said rod to said conductor to said primary radiator for radiation into said cavity; and means for rotating said rod on said post wherein said primary radiator moves in a circular horizontal path in said cavity.

8. The oven recited in claim 7 wherein said cross member is oblique to said waveguide.

9. The oven recited in claim 7 wherein said bore has a downward extending ball-shaped roof for minimizing the area of contact and rotating friction between said rod and said bearing post.

10. The oven recited in claim 7 wherein said bore is tapered.

11. The oven recited in claim 7 wherein said rotating means comprises microwave transparent vanes connected to said conductor.

12. The oven recited in claim 11 wherein said rotating means further comprises means for directing a flow of air against said vanes.

* * * * *